US007170537B2

(12) United States Patent
Helma et al.

(10) Patent No.: US 7,170,537 B2
(45) Date of Patent: Jan. 30, 2007

(54) CARD-CLEANING ASSEMBLY FOR CARD PRINTING DEVICES

(75) Inventors: Thomas R. Helma, Wakefield, RI (US); Terrence K. Jones, Jamestown, RI (US); Raymond E. Maynard, Westerly, RI (US)

(73) Assignee: ZIH Corp., Hamilton (BM)

( * ) Notice: Subject to any disclaimer, the term of this patent is extended or adjusted under 35 U.S.C. 154(b) by 378 days.

(21) Appl. No.: 10/807,658

(22) Filed: Mar. 24, 2004

(65) Prior Publication Data

US 2005/0052491 A1 Mar. 10, 2005

Related U.S. Application Data

(60) Provisional application No. 60/500,588, filed on Sep. 5, 2003.

(51) Int. Cl.
*B41J 2/32* (2006.01)
*B41J 2/315* (2006.01)

(52) U.S. Cl. ..... 347/171; 347/214

(58) Field of Classification Search ..... 347/215, 347/217–219, 213, 197–198, 171–174, 176; 400/120.01, 120.02, 120.04, 618
See application file for complete search history.

(56) References Cited

U.S. PATENT DOCUMENTS 4,009,047 A 2/1977 Lindsay
5,239,926 A 8/1993 Nubson et al.
5,401,111 A 3/1995 Nubson et al.
5,536,328 A 7/1996 Morgavi
5,584,589 A 12/1996 Adkins et al.
5,588,763 A 12/1996 Nubson et al.
5,667,316 A 9/1997 Nardone et al.
5,673,076 A 9/1997 Nardone et al.
5,685,043 A 11/1997 LaManna et al.
5,891,259 A 4/1999 Ikeda et al.
5,966,160 A 10/1999 Nardone et al.
2002/0106229 A1 8/2002 Meir et al.

FOREIGN PATENT DOCUMENTS

EP 0 253 618 A 1/1988
EP 0 350 050 A 1/1990

OTHER PUBLICATIONS

International Search Report, EPO, mailed Apr. 8, 2005.

*Primary Examiner*—K. Feggins
(74) *Attorney, Agent, or Firm*—Alston & Bird LLP

(57) ABSTRACT

A card-cleaning assembly for printers is provided. The assembly can be used in any suitable card printing apparatus, particularly thermal dye printers. Such card printers are used to print driver's licenses, employee badges, student cards, and the like. The assembly includes a card-cleaning roller and an adhesive tape cartridge. The cleaning roller contacts the card and removes dust and dirt particles and other debris from the surface of the card. The tape cartridge is attached to a pivoting arm on the printer which pivots so that the adhesive tape engages the cleaning roller and removes the debris from the roller as the roller rotates.

63 Claims, 12 Drawing Sheets

CARD-CLEANING ASSEMBLY FOR CARD PRINTING DEVICES

CROSS-REFERENCE TO RELATED APPLICATIONS

This application claims the benefit of U.S. Provisional Patent Application No. 60/500,588 having a filing date of Sep. 5, 2003, the entire contents of which are hereby incorporated by reference.

BACKGROUND OF THE INVENTION

The present invention relates generally to a printing apparatus for producing images on card substrates such as driver's licenses, employee badges, student cards, and the like. More particularly, the invention relates to a card-cleaning assembly for use in card printers, particularly thermal card printers. The assembly includes a card-cleaning roller and adhesive tape cartridge.

There are various known card printing apparatus which use a thermal printing process for producing colored images on card materials. In general, these printing devices use a conventional thermal dye transfer printing method, wherein a thermal printing head thermally-transfers dyes from a dye ribbon to a surface of the card. The thermal dye is transferred to and absorbed by the card's surface via a diffusion mechanism.

The thermal dye ribbon contains thermal dye panels of different colors, typically cyan (C), magenta (M), and yellow (Y), which are arranged in a repeating pattern. The dye ribbon may contain a black thermal dye panel (K) if desired. The colored panels may be arranged in an arbitrary order, or in a specific sequence that repeats itself along the ribbon. Typically, the colored panels are arranged in a CMYK color pattern. The printer can produce a full-colored image on the card's surface by combining the three primary colors. Generally, the card must make three separate passes under the print head (i.e., one pass for each color) in order to produce such a full-colored image.

Thus, in one type of thermal printer, the card is placed on a guided carriage or truck which moves forward on guide rails and transports the card to a position under the thermal print head. At this point, the first dye (for example, cyan) is thermally transferred to the dye-receptive surface of the card. After the card has been printed with the first dye, the carriage holding the card moves rearward and returns the card to a print-starting position. The dye transfer ribbon is advanced so that the second dye panel (for example, magenta) is in position, and the carriage again moves forward to a location under the print head. At this point, the second dye is transferred onto the card's surface. The second dye overlays the printed pattern formed by the first dye. Then, the card is returned to the print-starting position. Finally, the dye transfer ribbon is advanced again so that the third dye panel (for example, yellow) is in position, and the carriage again moves forward to a location under the print head. Then, the card which has been printed with the first and second dyes is further printed with the third dye to produce the full-colored image.

One problem with conventional thermal printers and thermal printing processes is the contamination and soiling of card substrates. The cards can be contaminated in a number of ways. For example, the card substrates typically are produced by cutting plastic sheets into the desired card shapes. This cutting operation can leave plastic shavings in the card packaging. Also, once the cards are removed from their packages, they are susceptible to air-borne contaminants such as dirt and dust particles. When the cover of the thermal printer is open, debris can fall into the printer and land on the cards. Air is circulated within printers, and this air can blow foreign matter onto the surfaces of the cards.

Card contamination creates several problems. For example, if the image is printed on a card surface loaded with dust and dirt particles and these particles fall off before lamination of the card, then the image under the particles may be lost. If the particles remain adhered to the surface, then defects may appear in the image, and the print quality may be poor. Further, the thermal print head is optimized to print on certain types of card stock. If the dust and dirt particles are large enough, they can cover the active elements of the print head and prevent these elements from transferring dye to the surface of the card. The dust and dirt particles can also damage the elements of the print head so that even after the element is cleaned, it will not transfer dye. Finally, a laminate is adhered to the card after the card is printed with an image. Contaminates trapped between the card and the laminate film will create bubbles that reduce the overall quality of the printed card.

The industry has attempted to address this problem by various means. For example, Morgavi, U.S. Pat. No. 5,536,328 discloses a cleaning card for a thermal card-printing machine having a station where the cards are electrically customized by means of a landing contact. According to the '328 Patent, the cleaning card has dimensions substantially identical to those of the cards to be printed. Further, the cleaning card is coated with two cleaning flat pads. One cleaning pad is coated with an adhesive material for collecting dust and dirt from the rollers in the machine. The other cleaning pad is coated with a material, such as abrasive paper, for cleaning the electrical contacts.

Nubson et al., U.S. Pat. No. 5,401,111 discloses an apparatus system for cleaning plastic cards such as credit or bank cards. According to the '111 Patent, the system can be used with thermal printers. The apparatus includes a pair of cleaning rollers which engage both sides of the card. The cleaning rollers have an adhesive coating for removing loose particulate matter from both sides of the card. The apparatus also includes an adhesive tape assembly for stripping the collected particulate matter away from the cleaning rollers. The surface of the adhesive tape is more adhesive than the surface of the cleaning rollers.

Nardone et al., U.S. Pat. Nos. 5,673,076, 5,667,316, and 5,966,160 disclose a card printing apparatus containing a silicone roller for removing dirt and dust particles from the surface of the card. An adhesive tape is used to clean the silicone roller. The tape lifts and collects the dirt and dust particles from the silicone roller. The Patents describe a tape assembly including a tape supply roll, tape take-up roll, and pivot arm. The adhesive cleaning tape is wound off the supply roll, around the pivot arm, and onto the take-up roller. This winding path produces tension in the tape and causes the pivot arm to pivot, thereby moving the tape into engagement with the silicone roller. The adhesive tape removes the dirt and dust particles from the roller as the roller rotates. The tape becomes disengaged from the silicone roller after the roller makes a complete revolution.

Although the tape assembly described in the '076, '316, and '160 Patents is effective in removing dirt and dust particles from the silicone roller, the assembly has some disadvantageous features. Particularly, the cleaning tape must be wound from a supply roll and around a pivot arm, and onto a take-up roller. It can be difficult and time-consuming to replace the cleaning tape, since the tape must be threaded along this complex path in each instance. Further, the tape can rip or jam during the cleaning process.

In view of the foregoing, it would be desirable to have a card-cleaning assembly that can be installed and removed easily from the thermal printer. One objective of the present invention is to provide such a card-cleaning assembly. Further, the cleaning assembly should be capable of dispensing the adhesive tape efficiently to remove dirt and dust particles and other debris from the card-cleaning roller. The present invention provides such a cleaning assembly. These and other objects, features, and advantages of this invention are evident from the following description and attached figures.

SUMMARY OF THE INVENTION

The present invention relates to a card-cleaning assembly comprising a card-cleaning roller and adhesive tape cartridge. The assembly can be used in any suitable printing apparatus, particularly thermal dye printers, for printing images on card substrates such as driver's licenses, employee badges, student cards, and the like.

The card-cleaning assembly comprises a card-cleaning means that includes a card-cleaning roller mounted to the printer frame, and a spring biasing means to urge the roller against a surface of the card so that the roller can collect debris from the card surface. The cleaning roller can be made from any suitable material such as rubber, and the spring biasing means can include a pair of springs.

The assembly further comprises a cleaning means that includes: (i) a pivot arm pivotably attached to the printer frame; and (ii) an adhesive tape cartridge mounted to the pivot arm. The tape cartridge includes a lower and upper tape core. A motor means or other suitable force causes the pivot arm to pivot so that the tape cartridge and cleaning roller engage each other. The tape removes debris from the roller as the tape is peeled from the lower tape core to the upper tape core and the cleaning roller rotates. The peeling of the tape exerts a force on the rotating cleaning roller, thereby causing the tape to maintain continuous contact with the roller. The assembly may further comprise a rotatable slotted wheel attached to the cleaning roller and an optical sensor for detecting movement of the slots on the wheel. A controller can be used to count the number of slots and detect when a full revolution of the roller has been made.

The card-cleaning assembly can be used in a thermal printer comprising a thermal print station and a linear transport system including a carriage or truck and linear guide means. The linear transport system can be used to convey the card to the print station and card-cleaning assembly. The thermal print may further include a card-flipping station and laminating station.

In another embodiment of the invention, a laterally-moving, non-rotatable plate member is used to clean the card material rather than a rotating cleaning roller. The pivot arm pivots so that the tape cartridge and plate member engage each other. Then, the tape can remove debris from the plate member as the tape is peeled from the lower tape core to the upper tape core and the plate member translates without rotation.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description taken in connection with the accompanying drawings in which:

DETAILED DESCRIPTION OF THE PREFERRED EMBODIMENTS

The card-cleaning assembly of the present invention can be used in any card printing apparatus. The cleaning assembly is particularly suitable for use in a thermal card printer. In general, a thermal card printer uses a thermal dye sublimation printing process to thermally transfer dyes onto a card substrate. The dyes can be used to print any indicia (for example, letters, numbers, symbols, photographs, and the like) on the surface of the card substrate.

Thus, the thermal printing process can be used to produce a wide variety of card materials, for example, passports, visas, driver's licenses, employee badges, student cards, credit cards, bank cards, security access cards, and the like. The card substrate, which is printed with the indicia, can be made from any suitable material. Examples of suitable dye-receiving card materials include plain papers and films made from polyesters, vinyls (for example, polyvinyl chloride and polyvinyl acetate), polyamides, polyolefins (for example, polyethylene and polypropylene), polyacrylates, polyimides, polystyrenes, and the like. Typically, a polyvinyl chloride plastic material is used to form the card. The card substrate has a front surface and a back surface. In some instances, only the front surface will be printed with the indicia, and this surface will be coated typically with a polymeric thermal dye-receptive layer. In other instances, it may be desirable to print indicia on both the front and back surfaces of the card, and both surfaces may be coated with a polymeric thermal dye-receptive layer.

As discussed above, the front and back surfaces of the card substrates may become contaminated during the thermal printing process. Particularly, the surfaces of the card may collect dirt and dust particles, shavings, and other foreign matter (hereinafter collectively referred to as "debris") as the card passes through the various components and stations in the printer. The present invention provides a card-cleaning assembly for removing this debris from the card surfaces.

Figure 1:
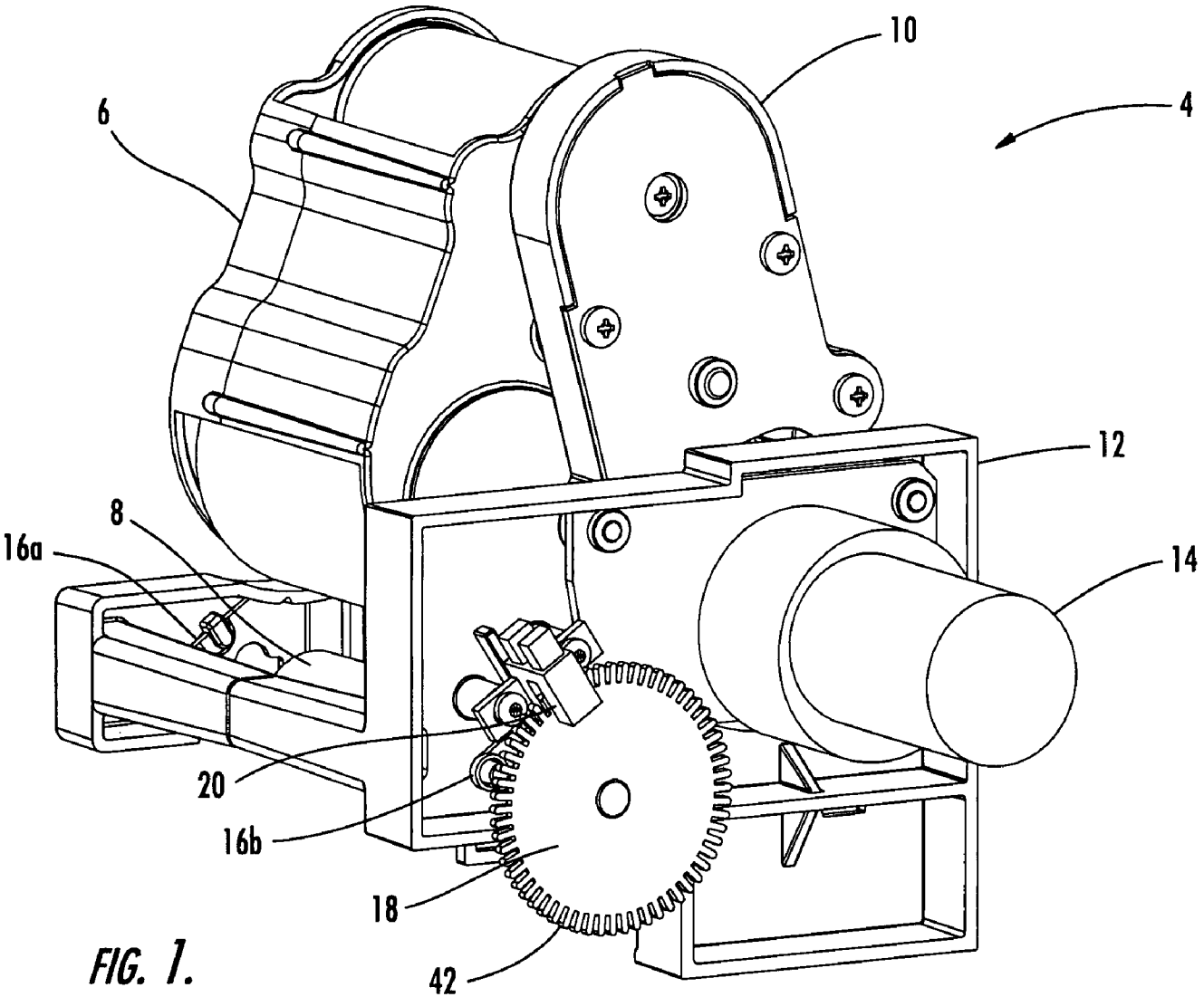
FIG. 1 is a side isometric view of the card-cleaning assembly of the present invention including the adhesive tape cartridge.
Figure 2A:
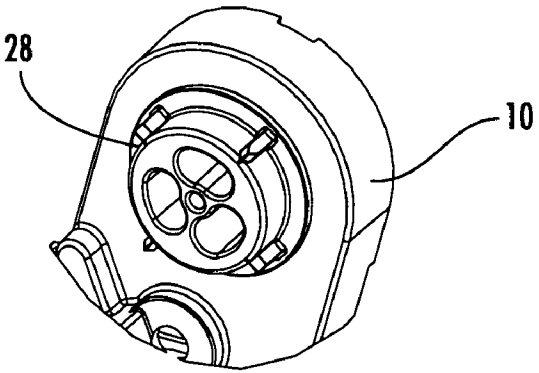
FIG. 2A is a close-up perspective view of the upper portion of the pivot arm shown in FIG. 2.
Figure 2:
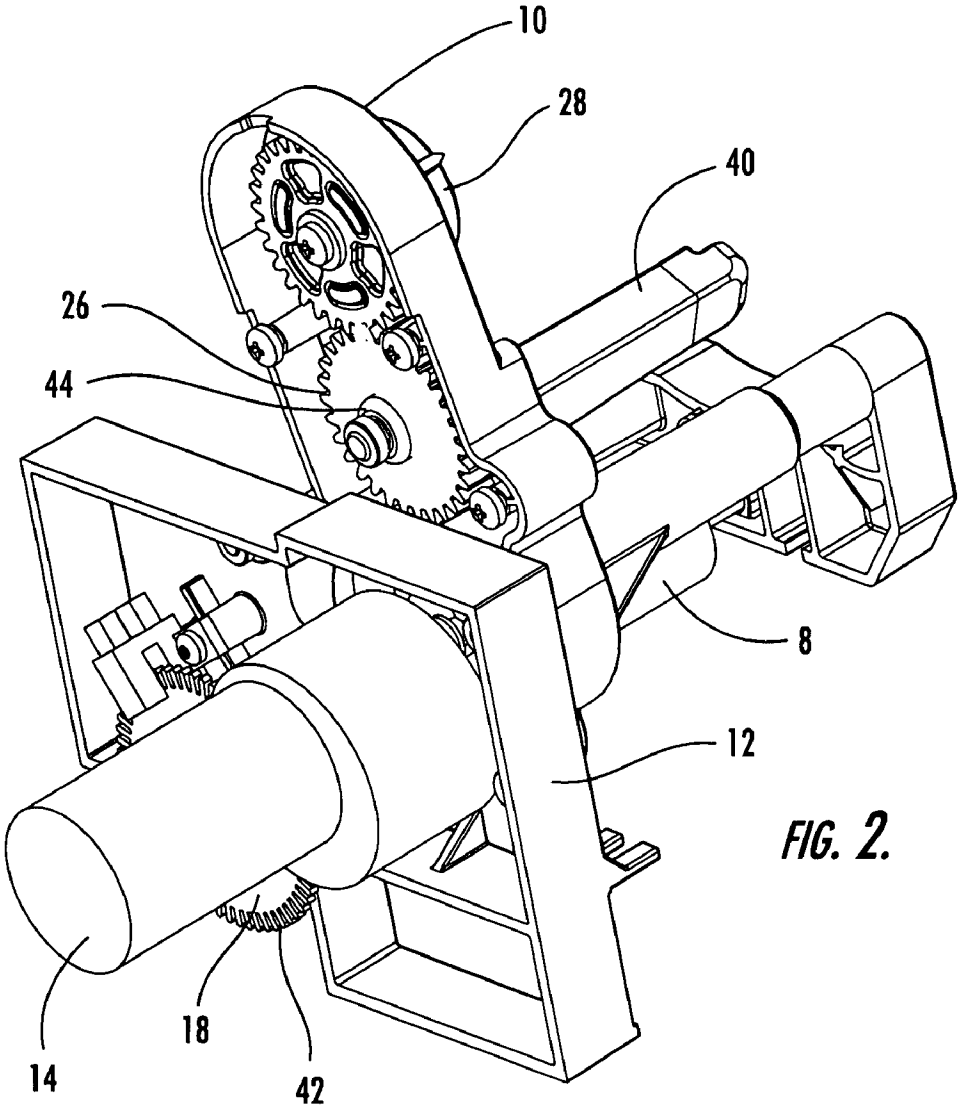
FIG. 2 is a cut-away isometric view of the assembly shown in FIG. 1 without the adhesive tape cartridge.

The card-cleaning assembly of the present invention is shown and generally indicated at 4 in FIG. 1. The card-cleaning assembly 4 includes a removable adhesive tape cartridge 6 and a card-cleaning roller 8. The tape cartridge 6 is mounted to a pivot arm 10 which is pivotably attached to the frame 12 of the printer (not shown). The pivot arm 10 is powered by motor 14. The card-cleaning roller 8 is mounted to the frame 12 by a pair of biasing springs 16*a* and 16*b*. The assembly 4 further includes a rotatable slotted wheel 18 attached to the card-cleaning roller 8. An optical sensor or encoder 20 is used to track rotation of the wheel 18. FIG. 2 shows a cut-away perspective view of the card-cleaning assembly 4 without the tape cartridge 6 mounted on the assembly. The various components of the pivot arm 10, as shown in the cut-away view of FIG. 2, are discussed in further detail below.

Figure 3:
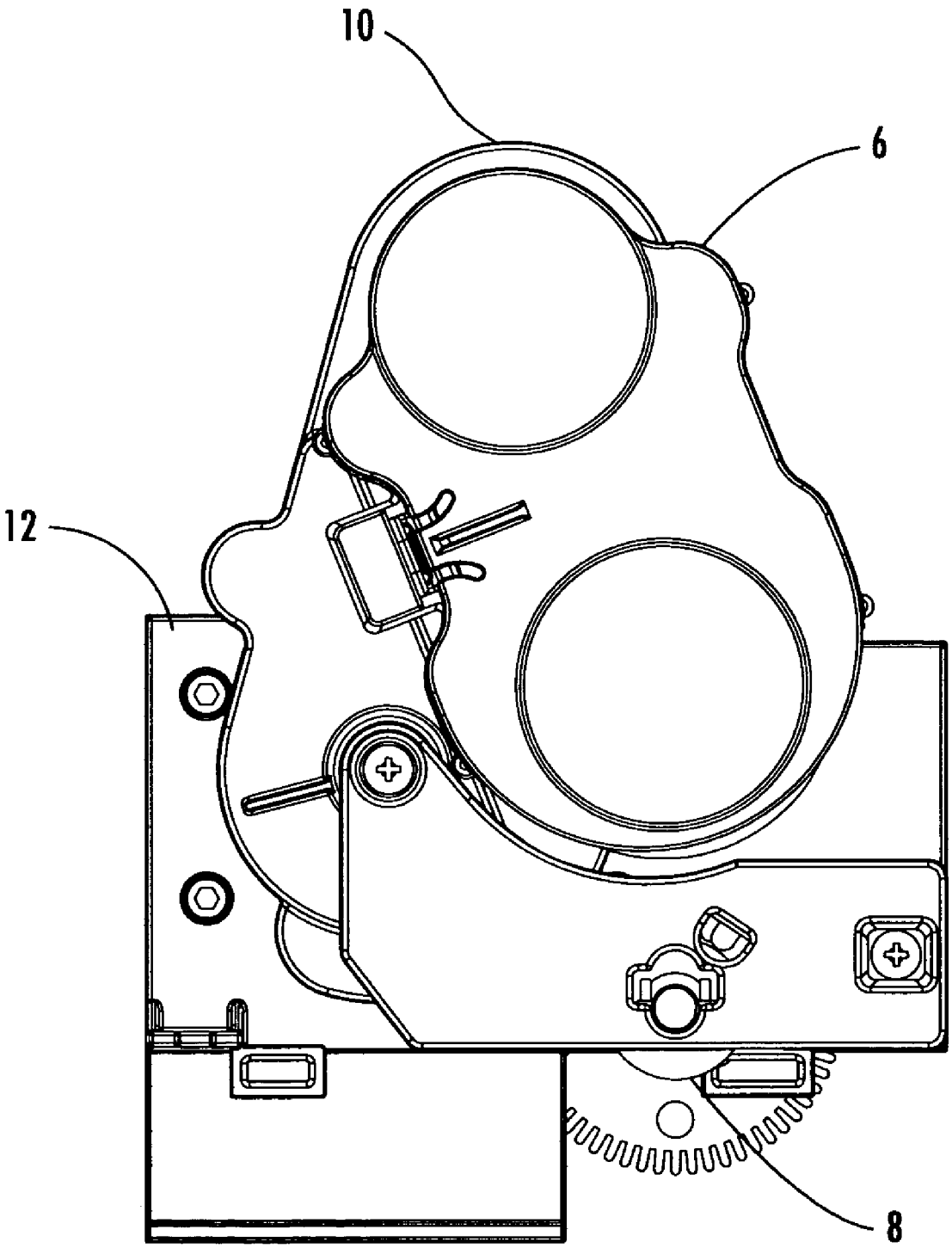
FIG. 3 is a side orthogonal view of the adhesive tape cartridge shown in the assembly of FIG. 1 with the tape cartridge in an up position and disengaged from the card-cleaning roller.
Figure 4:
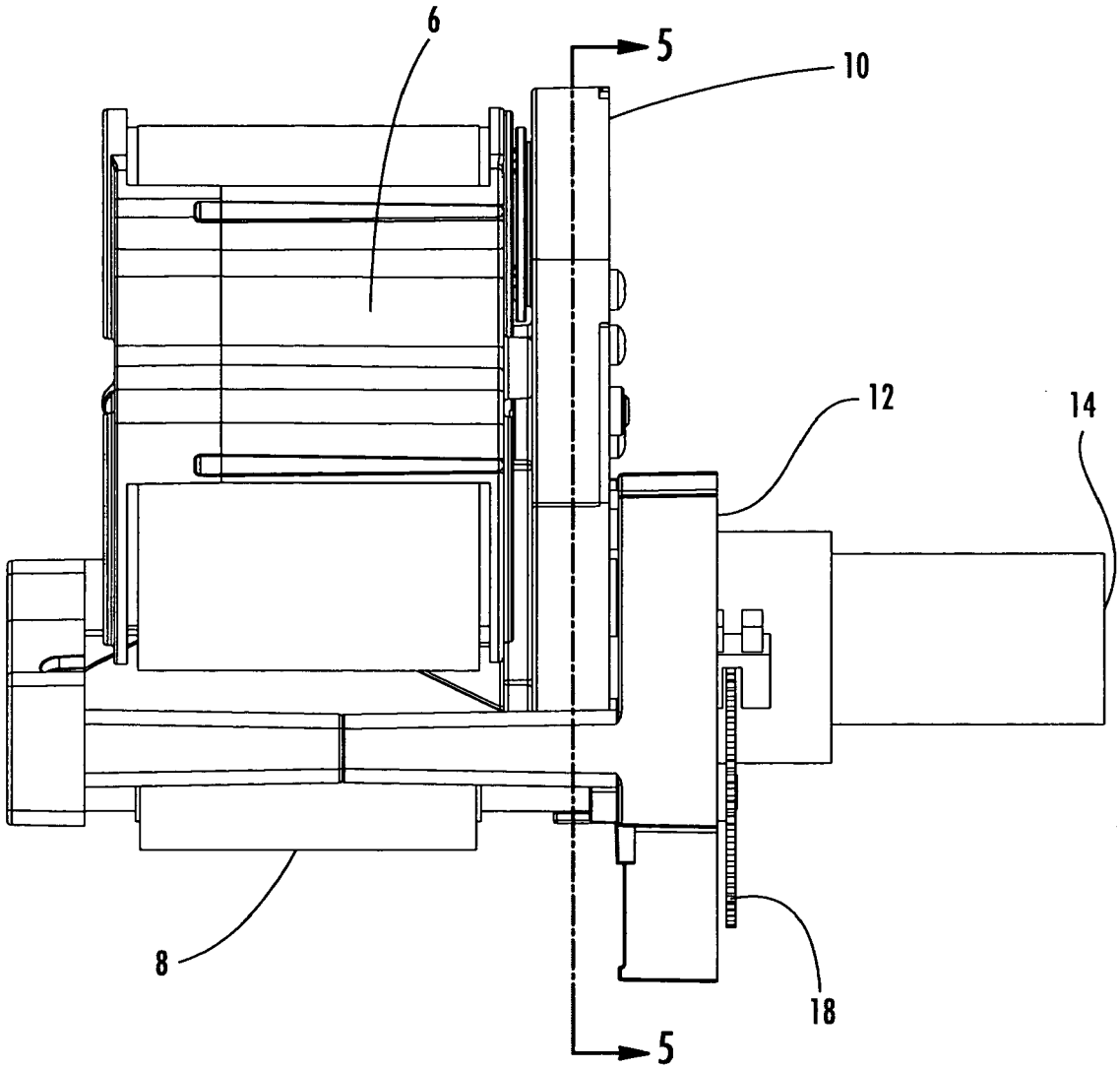
FIG. 4 is a front orthogonal view of the assembly shown in FIG. 1 with the adhesive tape cartridge in an up position and disengaged from the card-cleaning roller.
Figure 5:
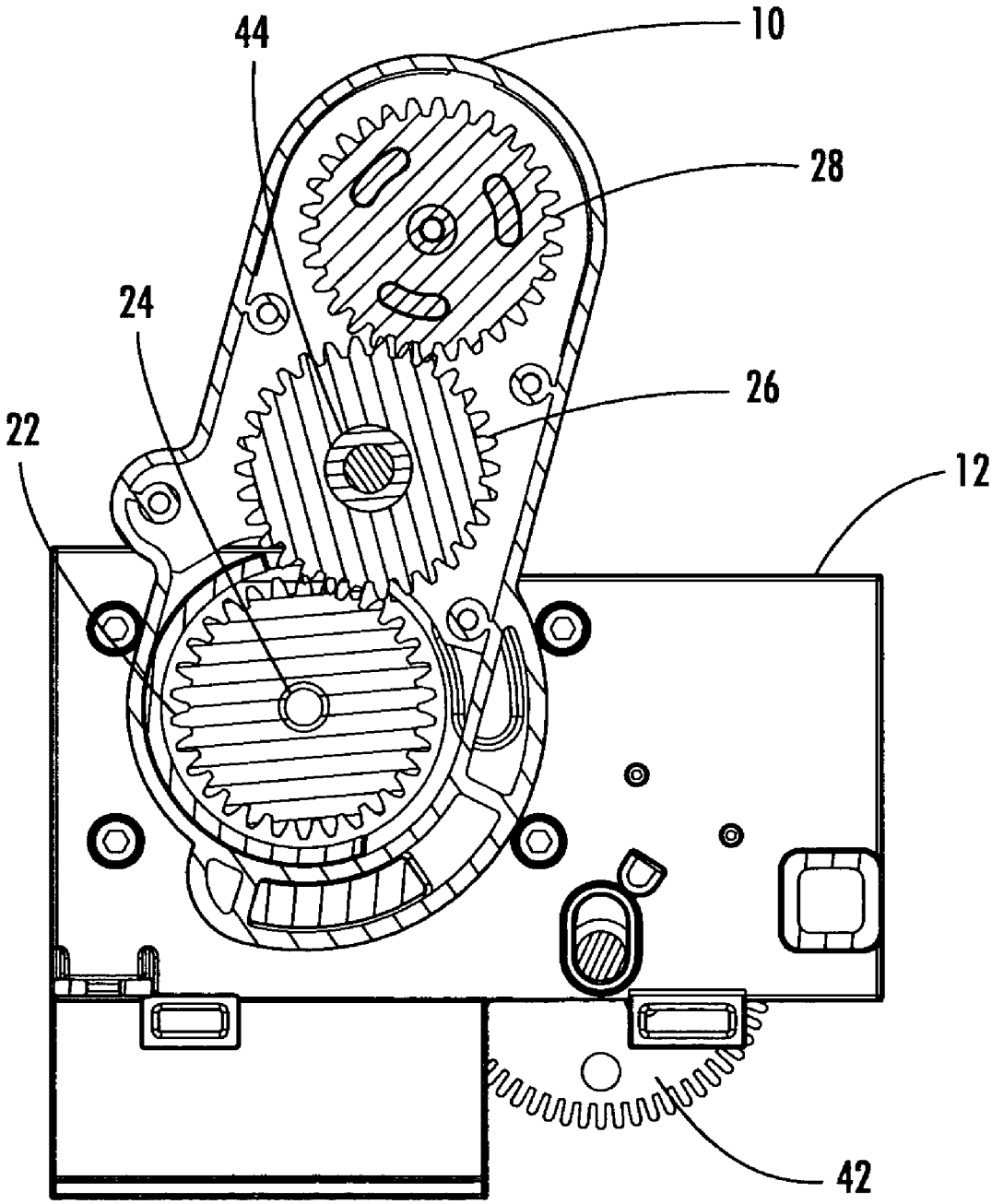
FIG. 5 is a cross-section view of the pivot arm of the assembly shown through Line 5—5 of FIG. 4.

As illustrated in FIGS. 3, 4, and 5, the tape cartridge 6 is initially in an up position, and the adhesive cleaning tape is not engaged with the cleaning roller 8. The tape cartridge 6 can be loaded into and unloaded from the assembly 4 in this up position. The mounting of the tape cartridge 6 in the assembly 4 is described in further detail below.

As a card substrate (not shown) passes beneath the cleaning roller 8, the biasing springs 16*a* and 16*b* press the roller 8 against a surface of the card. The cleaning roller 8 rotates and the springs 16*a* and 16*b* provide sufficient force so that the roller can remove dust and dirt particles and other debris from the surface of the card. The card-cleaning roller 8, itself, can be a conventional roller used in thermal dye printers. The cleaning roller 8 can be made from any suitable material. For example, the roller 8 can be made from a rubber material such as silicone, butyl, or urethane rubber. Typically, the length of the cleaning roller 8 and width of the card substrate, which is to be cleaned, are substantially the same dimensions. Thus, the cleaning roller 8 can effectively clean the entire surface of the card. This card-cleaning step is important, because it removes debris from the surface of the card which, if otherwise left on the surface, can cause printing and laminating problems as discussed above.

In order to remove the debris which has accumulated on the surface of the roller 8 during cleaning of the card, the tape cartridge 6 is activated. A motor means 14 is used to activate the tape cartridge 6. Referring to FIG. 5, a cut-away view of the pivot arm 10 is shown. The motor 14 causes the motor gear 22 and motor shaft 24 to rotate in a clockwise direction relative to the frame 12. Likewise, the pivot arm 10, which is pivotably attached to the motor shaft 24, rotates in a clockwise direction. The tape cartridge 6, which is attached to the pivot arm 10, rotates with the arm until the cartridge makes contact with the card-cleaning roller 8. The roller 8 acts as a stop means to prevent the tape cartridge 6 and pivot arm 10 from rotating further.

The motor 14 continues to turn with the pivot arm 10 resting in a stopped position, causing the idler gear 26 to be turned in a counterclockwise position relative to the frame. The idler gear 26 has a one-way clutch bearing which allows the gear to rotate only in the counterclockwise direction. In turn, the idler gear 26 intermeshes with the tape gear spline 28 so that the gear spline 28 rotates in a clockwise direction relative to the frame. A close-up view of the gear spline 28 in pivot arm 10 is shown in FIG. 2A.

Figure 6:
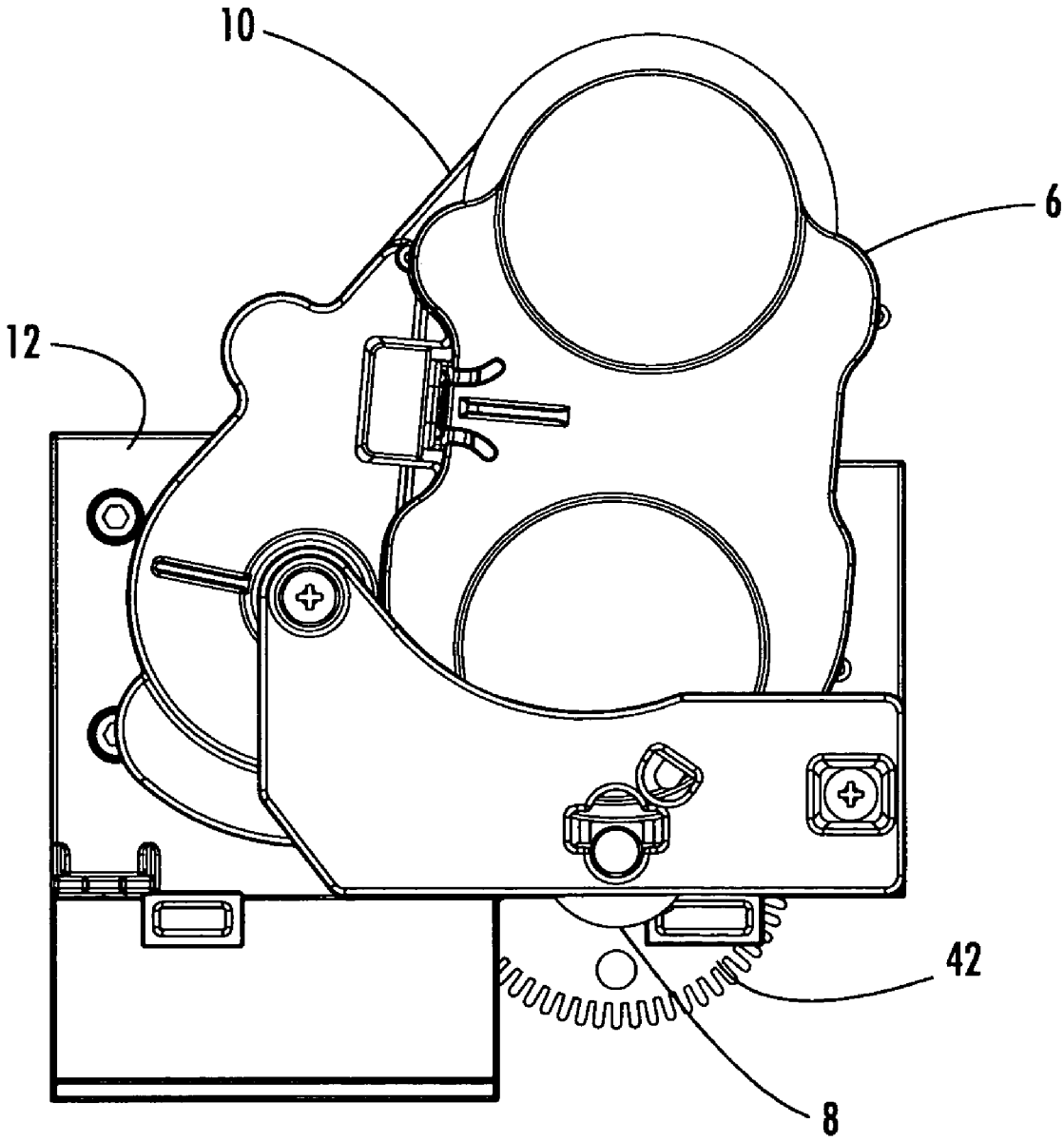
FIG. 6 is a side orthogonal view of the adhesive tape cartridge shown in the assembly of FIG. 1 with the tape cartridge in a down position and engaged with the card-cleaning roller.
Figure 7:
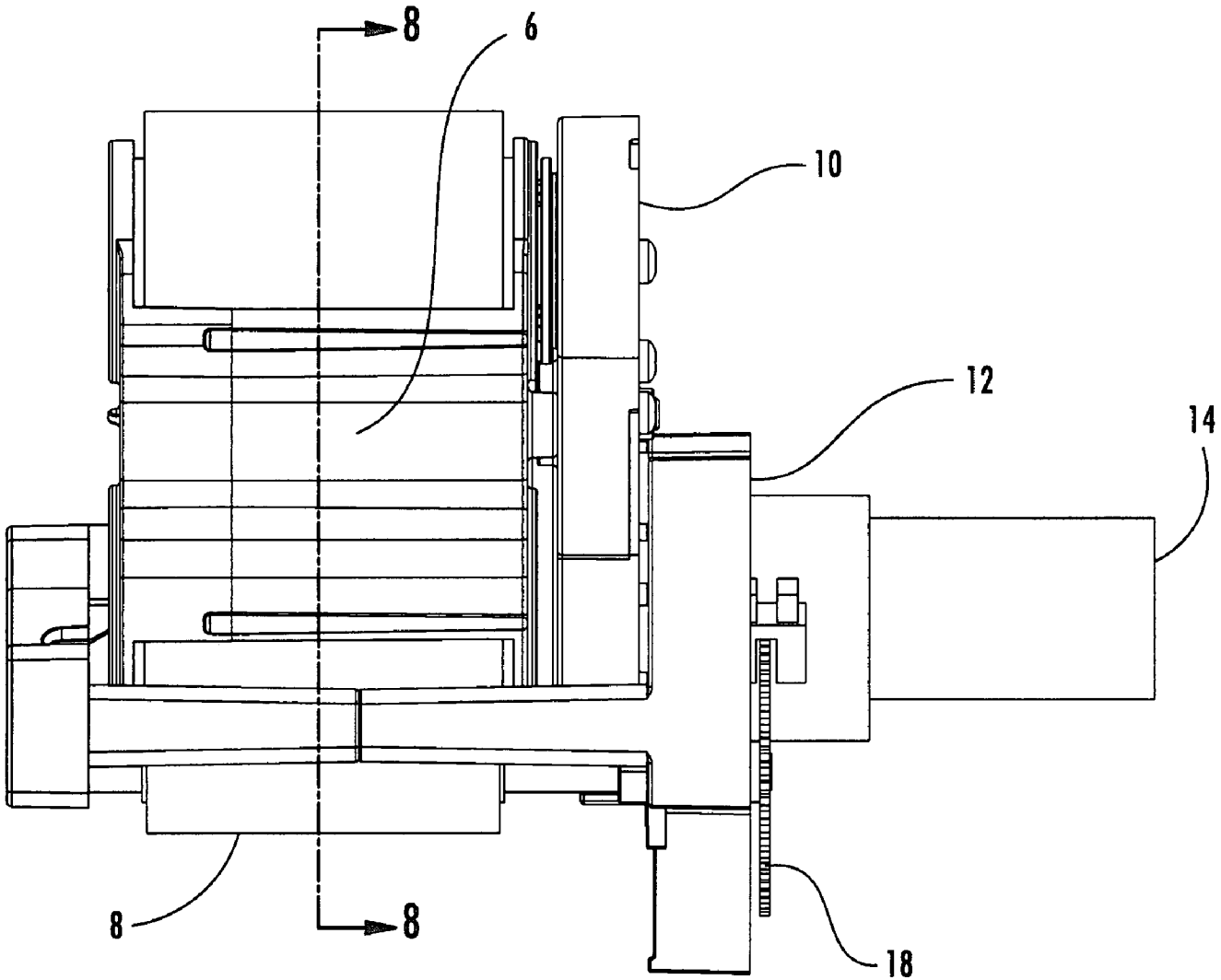
FIG. 7 is a front orthogonal view of the assembly shown in FIG. 1 with the adhesive tape cartridge in a down position and engaged with the card-cleaning roller.

As illustrated in FIGS. 6 and 7, the pivot arm 10 rotates downwardly and the tape cartridge 6 engages the cleaning roller 8, because there is no relative resistance to the downward motion of the pivot arm. The arm 10 will rotate downward, until the tape cartridge 6 strikes the card-cleaning roller 8. At this point, the arm 10 can continue rotating downward and through the roller 8, or the tape can be peeled from the cartridge 6 to clean the roller 8. Naturally, the tape is peeled from the tape cartridge 6, since the resistance for peeling the tape is less than the resistance that the cartridge 6 would face if it continued its downward motion against the roller 8. In other words, the peeling of the tape occurs, because this is the path of least resistance. The peeling of the tape within the tape cartridge 6 is discussed in further detail below.

Figure 8:
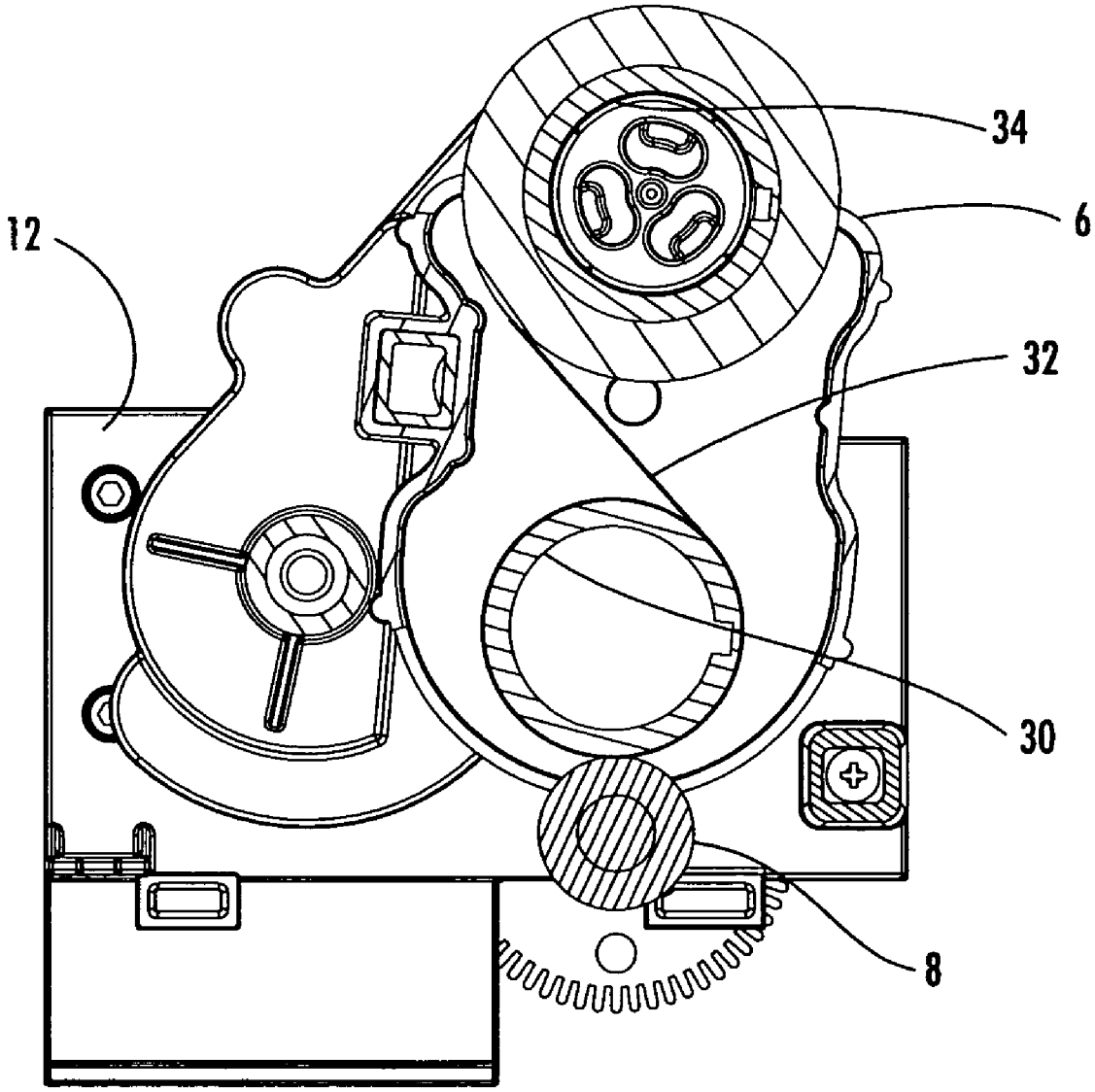
FIG. 8 is a cut-away orthogonal view of the adhesive tape cartridge through Line 8—8 of FIG. 7 showing the adhesive tape wound around the lower and upper tape cores.

As shown in FIG. 8, the tape cartridge 6 includes a lower tape core 30 for storing unused portions of the adhesive tape 32 and paying-out the tape to clean the card-cleaning roller 8. In addition, the tape cartridge 6 includes a motor-driven upper tape core 34 for peeling the tape from the lower tape core 30. The adhesive tape 32 is wound on the lower 30 and upper 32 cores so that the adhesive surface of the tape 32 is exposed, i.e., the sticky-side of the tape faces the cleaning roller 8. The tape 32 has an adhesive substance which is more adhesive than the surface of the card-cleaning roller 8 so that it can effectively "strip" the debris off the surface of the roller.

Figure 9:
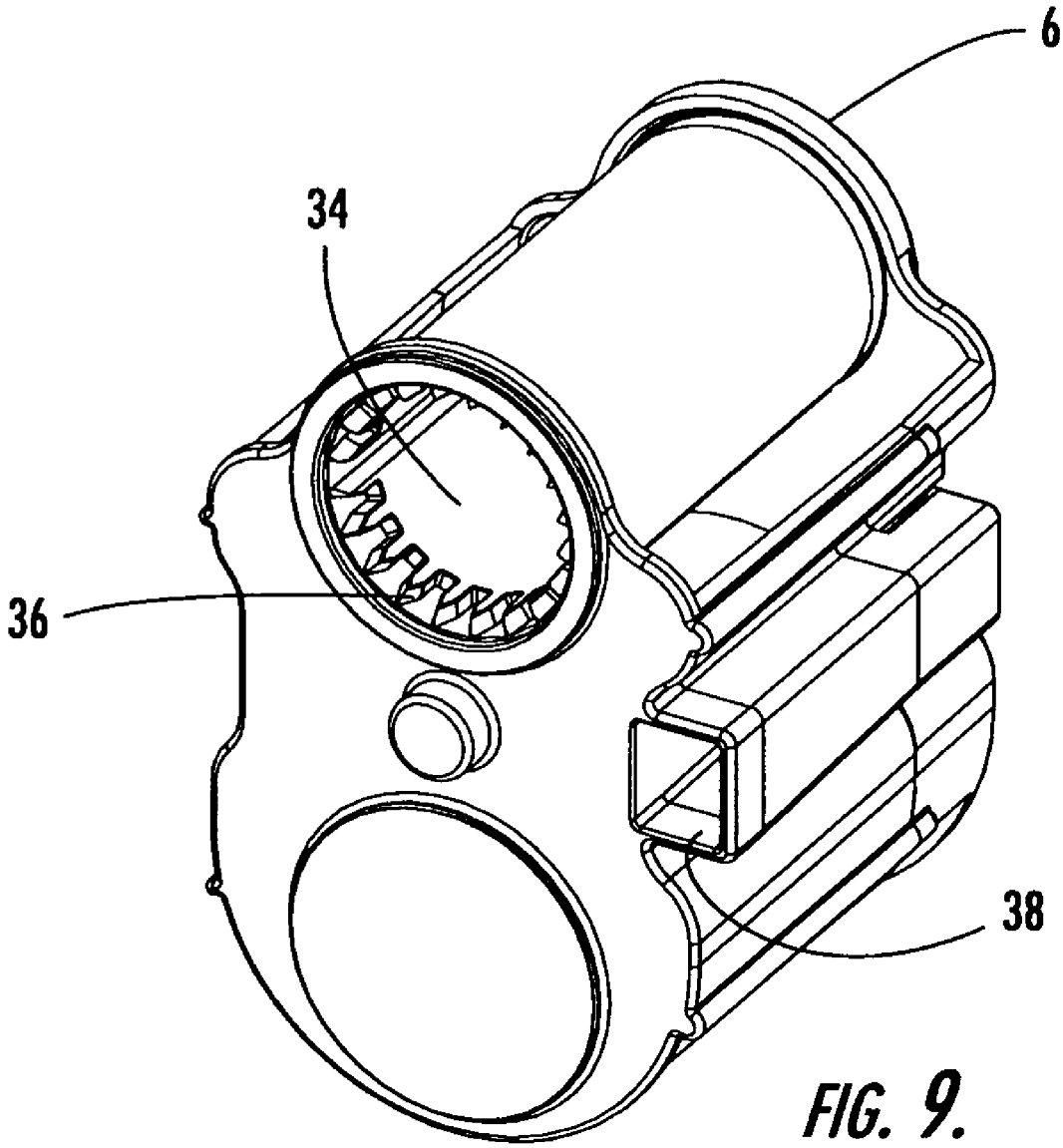
FIG. 9 is a perspective view of the adhesive tape cartridge showing the spline of the upper tape core.

Referring to FIG. 9, the spline 36 of the upper tape core 34 is shown in detail. The tape cartridge 6 is mounted on the pivot arm 10 by means of connecting the spline 36 to the tape drive spline gear 28 located on the pivot arm.

Figure 10:
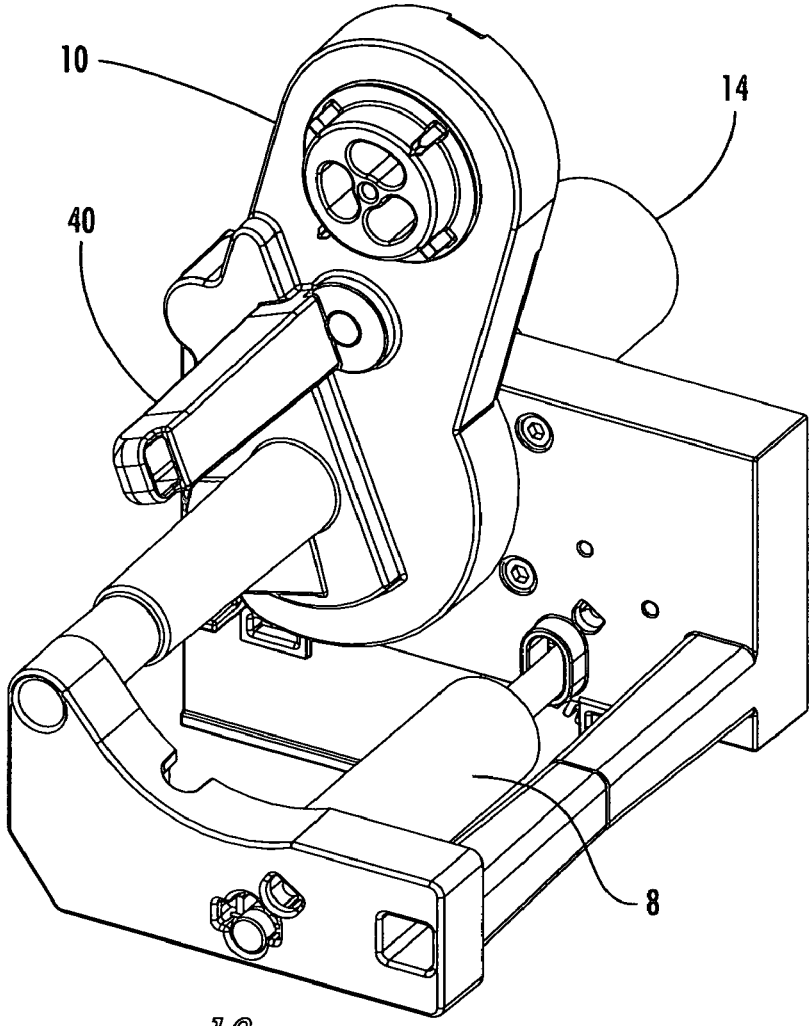
FIG. 10 is a side perspective view of the card-cleaning assembly of the present invention without the adhesive tape cartridge mounted thereon.
Figure 10A:
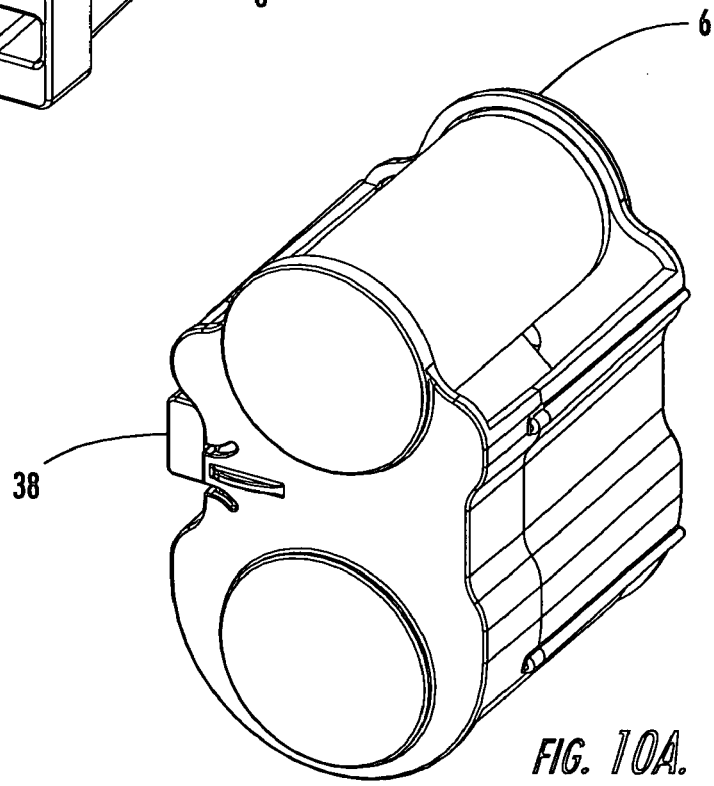
FIG. 10A is a side perspective view of the adhesive tape cartridge.
Figure 11:
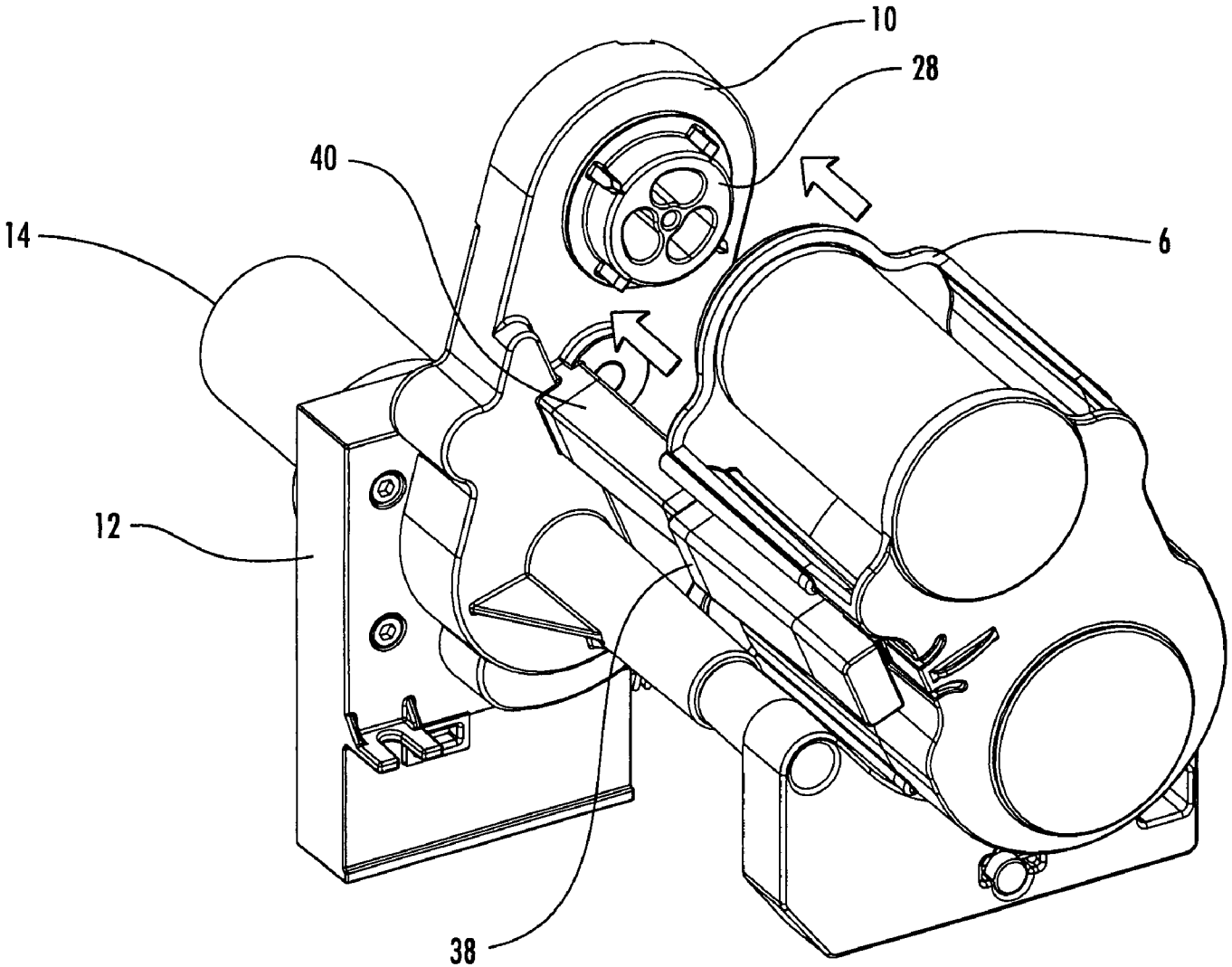
FIG. 11 is a partially exploded perspective view of the card-cleaning assembly showing the tape cartridge being mounted onto the pivot arm.

As illustrated in FIGS. 10, 11, and 11A, the tape cartridge 6 further includes a non-rotatable connector 38 adapted for receiving a mounting guide pin 40 extending from the pivot arm 10. The tape cartridge 6 is securely fastened to the pivot arm 10 by these attachment means.

Returning to FIG. 8 and the operation of the cleaning assembly, as the motor continues to turn, the upper tape core 34 rotates to pull the adhesive tape 32 from the rotating lower tape core 30 which, as described above, is in engagement with the cleaning roller 8. This action causes the tape 32 to pay-out from the lower core 30 and contact the surface of the cleaning roller 8. The adhesive tape 32 cleans and strips debris away from the roller 8 in this manner. Then, the upper tape core 34 takes-up and stores the used, dirty portion of the tape 32. As the upper core 34 exerts force to pull the tape 32 from the lower core 30, the cleaning roller 8 rotates. The peeling of the tape 32 by the upper tape core 34 causes the roller 8 to move at about twice the rotational speed as the lower tape core 30. Moreover, this force is sufficient to keep the tape 32 and cleaning roller 8 in continuous contact with each other.

As shown in FIG. 1, a rotatable slotted wheel 18 is attached to the cleaning roller 8. An optical sensor or encoder 20 detects the movement of the slots 42 on the wheel 18 as the wheel rotates and the slots pass across the sensor. A controller (for example, a microprocessor controller) can be used to count the number of slots 42 and detect when a full revolution of the roller 8 has been made. For example, the passing of sixty slots in front of the optical sensor 20 may indicate that the roller 8 has made a full rotation and been cleaned completely.

Then, the control system reverses the voltage to the motor 14. The motor 14 attempts to spin the idler gear 26 in a clockwise direction relative to the frame 12; however, a one-way clutch 44 (FIG. 5) prevents the idler 26 from turning in this direction. This burst of power from the motor 14 causes the pivot arm 10 to rotate in a counterclockwise direction relative to the frame. The pivot arm 10 moves upwardly from the cleaning roller 8. The tape cartridge 6, which is still mounted to the pivot arm 10, rotates with the arm and the adhesive tape 32 becomes disengaged from the cleaning roller 8. The roller 8 is now free to rotate and the cleaning assembly 4 is ready to clean the next card product. Typically, the adhesive tape 32 is used to clean the cleaning roller 8 after the roller 8 has cleaned about ten to fifteen cards.

As discussed above, the card-cleaning assembly of this invention can be installed in any suitable card printer including, but not limited to, thermal printers having printing and laminating stations. Generally, in a thermal printing process, a thermal dye ribbon is heated to transfer the ribbon dyes in a desired pattern to the dye-receptive surface of the card substrate. The dyes are transferred to the surface of the card in a pattern corresponding to the areas of the dye ribbon that are heated. This pattern is pre-determined and based upon electronic signals generated by a computer, video camera, electronic still camera, or the like, that are sent to the thermal transfer printer.

Many card agencies issue identification cards using a "three pass" color thermal printing process to generate colored indicia (photos, text, symbols, etc.) on the card substrate. This process allows card-issuing authorities to issue high quality colored cards over-the-counter. During the printing process, a first thermal dye panel is placed against the surface of the card and passed over the thermal printing heads as the card is advanced. This heating action transfers the thermal dye from the dye panel to produce a first colored print layer on the card. Other thermal dye panels are applied in subsequent passes to produce overlying print layers and the desired full-color print. The card-cleaning assembly of the present invention can be used to clean the surface of the card after each printing pass. In this manner, the surface of the card is kept clean and high quality prints can be obtained. After printing of the indicia, the card can be laminated with a film as is known in the art.

More specifically, the card-cleaning assembly of the present invention can be installed in the card printing apparatus disclosed in Nardone et al., U.S. Pat. Nos. 5,673,076, 5,667,316, and 5,966,160, the disclosures of which are hereby incorporated by reference. These thermal card printers include a carriage or truck which receives the card so that the dye-receptive surface of the card faces upwards and can be printed thereon. Then, the carriage is guided on a pair of rails and driven by a threaded rod to the thermal printing station. The threaded rod passes through a threaded bore in the carriage. A motor causes the threaded rod to rotate and drive the carriage to the printing station. The printer may further include a station for laminating the cards, and a flip station so that the card can be flipped over which allows printing and laminating to occur on both the front and back surfaces of the card.

Particularly, the thermal card printing devices, as described in the above-mentioned patents, comprise a thermal print station for thermally printing the selected indicia on a surface of a card substrate. Conventional thermal print means, such as thermal printheads, can be used. In such printing systems, a thermal dye ribbon is threaded between the print head and the dye receptive surface of the card and heated to thermally transfer the dye to the card's surface. The thermal card printers include a linear transport system for transporting the card beneath the printhead. The linear transport system comprises: (i) a carriage for receiving the card, wherein the card is positioned so that the surface of the card, to be printed, faces upwardly; (ii) a linear guide means for guiding the carriage beneath the print means; and (iii) a reversible drive means for driving the carriage in forward and rearward directions along the linear guide means.

Figure 12:
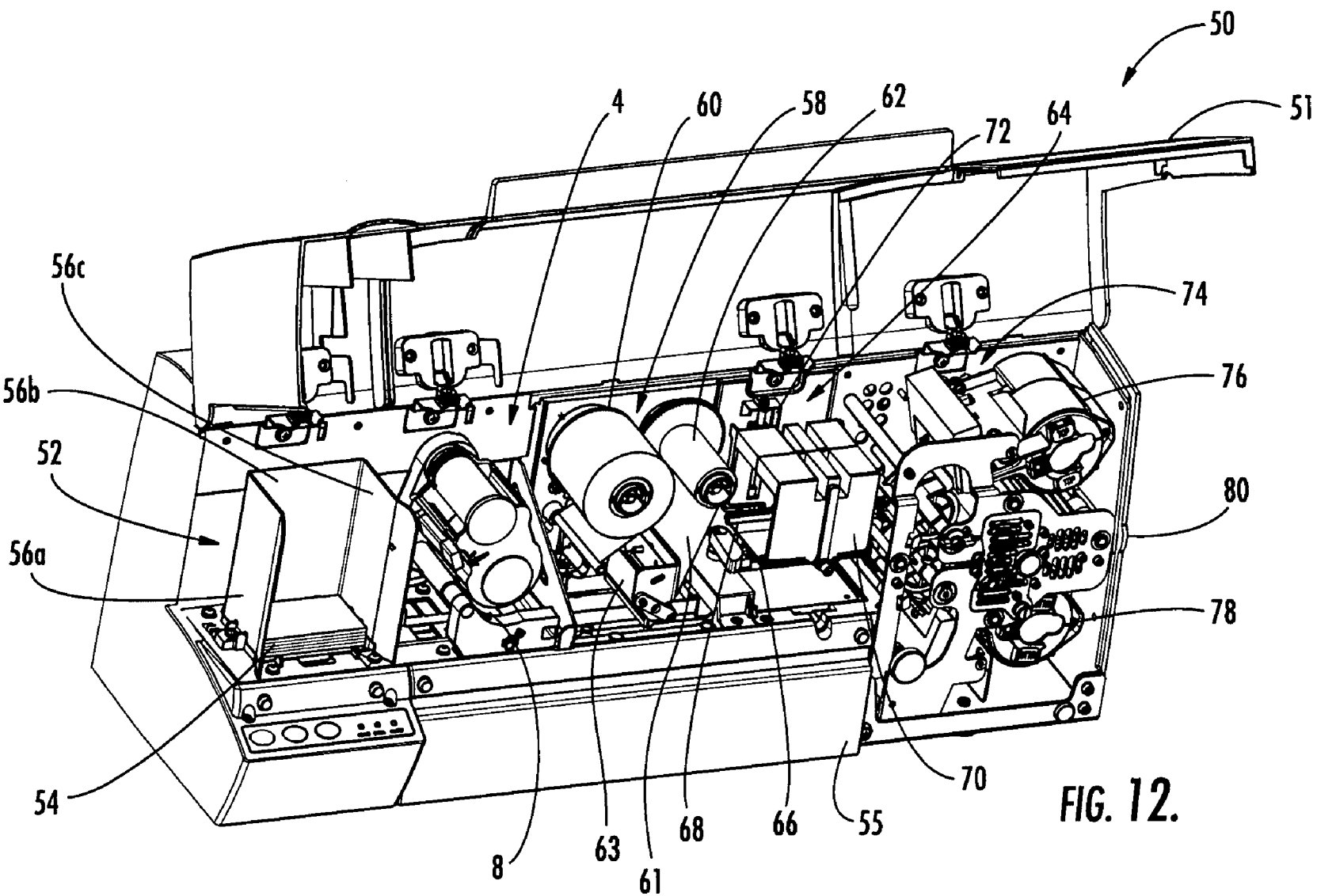
FIG. 12 is a perspective view of a thermal printer with its cover in an open position, the printer containing the card-cleaning assembly of the present invention.

The card-cleaning assembly 4 of this invention can also be installed in a thermal card printer which is generally indicated at 50 in FIG. 12. The card printer 50 includes a cover 51 which encloses the components of the printer. The cover 51 is shown in an opened position in FIG. 12. The components of the printer 50 include a card hopper 52 for storing the cards 54 to be printed thereon. The card hopper 52 includes sidewall portions, 56*a*, 56*b*, and 56*c*, which define a rectangular chute for holding the cards 54. The bottom portion of the hopper 52 is open to allow a carriage (not shown) to move beneath the stack of cards 54 and pick-up a card for transporting through the various stations of the printer.

In operation, the carriage is positioned initially to the right of the card hopper 52. The carriage is driven rearwardly (to the left direction in FIG. 12) so that it passes beneath the card hopper 52, where upon the card 54 located at the bottom of the stack is dropped into the carriage. Then, the carriage is driven forwardly (to the right direction in FIG. 12) and towards the card-cleaning assembly 4 of this invention. The carriage is guided through the card-cleaning station 4 and various other stations in the printer on a pair of parallel guide rails (not shown). The carriage is driven by a threaded rod (not shown) rotatably mounted in bearing assemblies located at each end of the printer frame. A reversible motor (not shown) is used for rotating the threaded drive rod in forward and reverse directions so that the carriage moves in each direction. This card transport system is enclosed behind side panel 55 of the card printer 50 shown in FIG. 12.

The card 54 is transported beneath the cleaning roller 8 of the cleaning assembly 4 and dirt and dust are removed from the surface of the card 54 according to the cleaning mechanism described above. Subsequent to this cleaning step, the carriage is driven further to the right so that the card 54 passes beneath a thermal print assembly generally indicated at 58 which prints an image onto the surface of the card 54. The print assembly 58 includes a supply roll 60 and take-up roll 62 for feeding a thermal dye ribbon 61 between a thermal print head 63 and surface of the card 54. The print head moves between a first printing position and a second non-printing position. In the first position, the print head engages the card and transfers the thermal dye to the surface of the card. In the second non-printing position, the print head is in an idle position and disengaged from the card.

In a three-pass printing operation, the card is passed under the print head three successive times to produce a full-colored image as discussed above. In the first printing pass, a first dye (for example, cyan) is thermally transferred to the card. After the card has been printed with the first dye, the carriage holding the card moves rearward and returns the card to a print-starting position. Then, the dye ribbon is advanced to move the second dye panel (for example, magenta) into position, and the carriage again moves forward to a location under the print head. The second dye is transferred onto the card's surface at this point so that it overlays the printed pattern formed by the first dye. Then, the card is returned to the print-starting position. Finally, the dye transfer ribbon is advanced again to move the third dye panel (for example, yellow) into position, and the carriage again moves forward to a location under the print head. Then, the card is printed with the third dye.

After this three-pass printing process, the carriage transports the card to the card-flipping assembly generally indicated at 64. The card-flipping assembly 64 can be used to flip a card over so that both sides of the card can be printed thereon. The card 54 is guided from the carriage to the card-retaining flip guides 66 and 68 of the card-carrier unit 70. The card 54 is transported vertically along the vertical guide rail 72 to a position, where the flip guides 66 and 68 can rotate and flip the card over. Then, the card-carrier unit 70 is lowered, and the inverted card is returned to the carriage. The carriage now can be driven again through the thermal print assembly 58 to produce a printed image on the back surface of the card. This card-flipping mechanism allows for printing on both the front and back surfaces of the card and is described in further detail in co-pending, co-assigned, U.S. patent application, "Card-Flipping Device For Use In Card Printers", the disclosure of which is hereby incorporated by reference.

In addition, the card printer includes a lamination station 74 for laminating the surfaces of the card with a film. The laminating station 74 can include a top laminate supply roll 76 and a bottom laminate supply roll 78 which are driven independently by stepper motors. A laminate film is fed between the heated laminating assembly and surface of the card. The laminating station 74 overlays the laminate film onto the surface of the card. Finally, the printed and laminated card is discharged from the printer 50 through an exit slot 80.

Also, it is recognized that the cleaning assembly 4 of the present invention can be used for purposes other than cleaning card substrates. For example, the roller 8 may be used to polish, emboss, or grind the substrate.

It is further recognized that the cleaning assembly 4 of this invention may be used to treat materials other than card substrates. For example, a web of paper or film may be passed under the roller and cleaned accordingly.

In other embodiments of this invention, a laterally-moving, non-rotatable plate member can be used to clean the card substrate, rather than a rotating cleaning roller. Such a plate member can be used provided that the adhesive tape can engage and generate a sufficient force to translate the plate in a manner similar to the above-described process. The tape cartridge and plate member engage each other as described above. Then, the tape can remove debris from the plate member as the tape is peeled and the plate member translates without rotation.

It is appreciated by those skilled in the art that various other changes and modifications can be made to the illustrated embodiments and description herein without departing from the spirit of the present invention. All such changes and modifications are intended to be covered by the appended claims.

What is claimed is:

1. A card-cleaning assembly for a printer, comprising:

a card-cleaning means comprising a card-cleaning roller mounted to a frame of the printer and adjacent to a surface of the card so that the roller collects debris from the card surface; and a cleaning means for removing debris from the card-cleaning roller, the cleaning means, comprising:

(i) a pivot arm pivotably attached to the printer frame; and (ii) an adhesive tape cartridge mounted to the pivot arm, the tape cartridge comprising:

(a) a housing adaptable for connection to a card cleaning assembly of the printer;

(b) a supply tape core located at a first position in said housing, said supply tape core containing a media having at least one surface coated with an adhesive material; and (c) a take up tape core located at a second position in said housing spaced apart from said supply tape core, said take up tape core receives the media as the media is paid out from said supply roll, wherein a force exerted on the pivot arm causes the arm to pivot so that the tape cartridge and cleaning roller engage each other, and the tape removes debris from the roller as the tape is peeled from the supply tape core to the take up tape core and the cleaning roller rotates.

2. The card-cleaning assembly of claim 1, wherein the cleaning roller is made from a rubber material.

3. The card-cleaning assembly of claim 1 further comprising spring biasing means connected to said card-cleaning roller to urge said card cleaning roller against the surface of the card.

4. The card-cleaning assembly of claim 1, wherein a motor means causes the pivot arm to pivot so that the tape cartridge and cleaning roller engage each other.

5. The card-cleaning assembly of claim 4, wherein the pivot arm comprises a motor gear and shaft for driving the arm.

6. The card-cleaning assembly of claim 5, wherein the pivot arm further comprises an idler gear having a one way clutch.

7. The card-cleaning assembly of claim 6, wherein the pivot arm further comprises a drive gear spline.

8. The card-cleaning assembly of claim 1, wherein the upper core of the tape cartridge comprises a spline for mounting the tape cartridge to the pivot arm.

9. The card-cleaning assembly of claim 1, wherein the peeling of the tape exerts a force on the cleaning roller, thereby causing the tape to maintain continuous contact with the cleaning roller as the roller rotates.

10. The card-cleaning assembly of claim 9, wherein the peeling tape exerts a force on the cleaning roller so that the roller rotates at about twice the rotational speed as the lower tape core.

11. The card-cleaning assembly of claim 1, further comprising a rotatable slotted wheel attached to the cleaning roller and an optical sensor for detecting movement of the slots on the wheel.

12. The card-cleaning assembly of claim 1, wherein the printer is a thermal printer.

13. The thermal printer apparatus of claim 12, wherein the linear transport system further comprises a card-flipping means for lifting the card from the carriage, rotating the card, and returning the card to the carriage, whereby the other surface of the card faces upwards in the carriage and can be printed thereon.

14. The thermal printer apparatus of claim 12, further comprising a lamination station for laminating a film to a surface of the card.

15. A thermal printer apparatus, comprising:

a) a print station for thermally printing indicia on a surface of a card substrate;

b) a linear transport system for transporting the card beneath the print station; and c) a card-cleaning means for cleaning the surface of the card as the card is transported in the printer, the card-cleaning means, comprising:

a card-cleaning roller mounted to a frame of the printer and in contact with a surface of the card so that the roller collects debris from the card surface; and a cleaning means for removing debris from the card-cleaning roller, the cleaning means, comprising:

(i) a pivot arm pivotably attached to the printer frame; and (ii) an adhesive tape cartridge mounted to the pivot arm, the tape cartridge including a supply tape core and a take up tape core;

wherein a force exerted on the pivot arm causes the arm to pivot so that the tape cartridge and cleaning roller engage each other, and the tape removes debris from the roller as the tape is peeled from the supply tape core to the take up tape core and the roller rotates.

16. A card-cleaning assembly for a printer, comprising:

a card-cleaning means comprising a translating plate member mounted to a frame of the printer, said plated member being capable of contacting a surface of the card so that the plate collects debris from the card surface; and a cleaning means for removing debris from the card-cleaning plate member, the cleaning means, comprising:

(i) a pivot arm pivotably attached to the printer frame; and (ii) an adhesive tape cartridge mounted to the pivot arm, the tape cartridge comprising:

(a) a housing adaptable for connection to a card cleaning assembly of the printer;

(b) a supply tape core located at a first position in said housing, said supply tape core containing a media having at least one surface coated with an adhesive material; and (c) a take up tape core located at a second position in said housing spaced apart from said supply tape core, said take up tape core receives the media as the media is paid out from said supply roll, wherein a force exerted on the pivot arm causes the arm to pivot so that the tape cartridge and plate member engage each other, and the tape removes debris from the plate as the tape is peeled from the supply tape core to the take up tape core and the plate member translates.

17. A card-cleaning assembly for a printer, comprising:

a roller mounted to a frame of the printer and adjacent to a surface of a card in the printer such that the roller collects debris from the surface of the card;

a pivot arm connected to the frame of the printer;

a supply tape core and a take up tape core containing a media having at least one adhesive surface, wherein at least one of said supply tape core and said take up tape core is coupled to said pivot arm, means for applying a force to said pivot arm, wherein the force exerted on the pivot arm causes the arm to pivot toward said roller so that the media engages said roller to thereby remove debris from the roller, wherein both of said supply and take up tape cores are coupled to said pivot arm.

18. A card-cleaning assembly for a printer, comprising:

a roller mounted to a frame of the printer and adjacent to a surface of a card in the printer such that the roller collects debris from the surface of the card;

a pivot arm connected to the frame of the printer;

a supply tape core and a take up tape core containing a media having at least one adhesive surface, wherein at least one of said supply tape core and said take up tape core is coupled to said pivot arm, means for applying a force to said pivot arm, wherein the force exerted on the pivot arm causes the arm to pivot toward said roller so that the media engages said roller to thereby remove debris from the roller, wherein said supply tape core is in contact with said roller when said pivot arm is pivoted toward said roller.

19. An assembly according to claim 18, wherein said means for applying a force comprises a motor coupled to said pivot arm.

20. An assembly according to claim 19, wherein said means for applying a force further comprises a motor gear and shaft for driving the arm.

21. An assembly according to claim 20, wherein said means for applying a force further comprises an idler gear having a one way clutch.

22. An assembly according to claim 18 further comprising an encoder in communication with said roller for detecting rotation of said roller.

23. A card-cleaning assembly for a printer, comprising:

a roller mounted to a frame of the printer and adjacent to a surface of a card in the printer such that the roller collects debris from the surface of the card;

a pivot arm connected to the frame of the printer;

a supply tape core and a take up tape core containing a media having at least one adhesive surface, wherein at least one of said supply tape core and said take up tape core is coupled to said pivot arm, means for applying a force to said pivot arm, wherein the force exerted on the pivot arm causes the arm to pivot toward said roller so that the media engages said roller to thereby remove debris from the roller, wherein said supply and take up tape cores are located in a cartridge.

24. A method for cleaning a card located in a card printer comprising:

providing a pivot arm connected to the frame of the printer;

providing a supply tape core and a take up tape core containing a media having at least one adhesive surface wherein at least one of said supply tape core and said take up tape core is coupled to said pivot arm;

contacting a roller to a surface of the card such that the roller collects debris from the surface of the card;

applying a force to the pivot arm, wherein the force exerted on the pivot arm causes the arm to pivot toward said roller so that the media engages the roller to thereby remove debris from the roller.

25. A method according to claim 24, wherein said providing a supply tape core and a take up tape core provides both of tine supply and take up tape cores on the pivot arm.

26. A method according to claim 24 wherein in said applying step the supply tape core is in contact with the toiler when said pivot arm is pivoted toward the roller.

27. A method according to claim 24, wherein said applying step drives the pivot arm toward the roller using a motor coupled to the pivot arm.

28. A method according to claim 24, wherein said applying step drives the pivot arm toward the roller using a motor assembly coupled to the pivot arm, the motor assembly comprising:

a motor;

a motor gear;

a shaft; and an idler gear having a one way clutch.

29. A method according to claim 24 further comprising detecting rotation of the roller.

30. A card-cleaning assembly for a printer, comprising:

a roller mounted to a frame of the printer and adjacent to a surface of a card in the printer such that the roller collects debris from the surface of the card;

a supply tape core and a take up tape core containing a media having at least one adhesive surface, said media in operable communication with said roller for removing debris from said roller; and an encoder in communication with said roller for detecting rotation of said roller.

31. An assembly according to claim 30 further comprising a pivot arm connected to the frame of the printer, wherein at least one of said supply and take up tape cores are connected to said pivot arm and said pivot arm being capable of selectively contacting the media with said roller.

32. An assembly according to claim 31 further comprising a processor in communication with said encoder and said pivot arm, wherein said processor controls said pivot arm to contact the media with said roller for a selected amount of rotation of said roller.

33. An assembly according to claim 32, wherein said processor controls said pivot arm to contact the media with said roller for at least one full rotation of said roller.

34. A method for cleaning a card in a card printer comprising:

contacting a roller with a surface of a card to be cleaned such that the roller collects debris from the surface of the card;

selectively contacting a media having at least one adhesive surface with said roller for removing debris from said roller; and detecting rotation of said roller with an encoder.

35. A method according to claim 34, wherein said selectively contacting step contacts the media with the roller for a selected amount of rotation of the roller, where the amount of rotation is detected by said detecting step.

36. A method according to claim 35, wherein said selectively contacting step contacts the media with the roller for at least one fall rotation of said roller.

37. A cartridge for cleaning cards in a card printer comprising:

a housing;

a media having at least one surface coated with an adhesive material;

a supply roll located in said housing and containing a supply of said media;

a take up roll spaced apart from said supply roll in said housing, said take up roll for receiving said media as said media is paid out from said supply roll, wherein said supply roll comprises a core comprising a body having an outer surface for maintaining said media, and wherein said media comprises an adhesive on a first surface, wherein said media is wound about the outer surface of said supply roll such that said first surface is opposite the outer surface of said core of said supply roll.

38. A cartridge according to claim 37, wherein said take up roll comprises a core comprising a body having an outer surface for maintaining said media, and wherein said media comprises an adhesive on a first surface, wherein said media is wound about the outer surface of said supply roll such tat said first surface faces the outer surface of said core of said take up roll.

39. A device for cleaning cards in a card printer comprising:

a media having at least one surface coated with an adhesive material;

a supply roll containing a supply of said media;

a take up roll spaced apart from said supply roll, said take up roll for receiving said media as said media is paid out from said supply roll, wherein at least one of said supply roll and take up roll comprises a core having one or more splines located in an inner surface of said core, whereby said spline facilitates connection of said core to a spindle of a cleaning apparatus.

40. A device according to claim 39, wherein said core has a body extending axially between opposed ends and said spline extends axially along said body.

41. A device according to claim 39, wherein said spline comprises a body extending between opposed ends in a direction generally parallel to an axial direction of said core and said body of said spline is tapered in the axial direction along at least a portion of the body.

42. A device according to claim 39, wherein said spline comprises sidewalls that extend from the inner surface of said core to a top surface, wherein at least a portion of the sidewalls are angled.

43. A device according to claim 39, wherein said core comprises a body extending between opposed ends and two or more splines located in an inner surface of said core and extending axially, wherein said two or more splines have respective distal ends that are connected to each other by a wall extending in a generally circumferential direction.

44. A device according to claim 39, wherein said core comprises at least two splines spaced apart from each other creating a slot between said splines.

45. A device according to claim 39, further comprising a plurality of splines arranged circumferentially about the inner surface of said core, said splines extending in a generally axial direction of the core and defining a plurality of slots therebetween, a first end of each spline being tapered in the axial direction such that each slot defines a first portion and a second portion, the first portion of each slot being wider circumferentially than the second portion and the first portion being disposed between a first end of the core and the second portion of the slot such that each fast portion of each slot is configured to guide a portion of the spindle into said second portion when the first end of the core is advanced toward the spindle.

46. A device according to claim 39 further comprising a housing connected between said supply and take up rolls, such that the housing supports the supply and take up rolls in a spaced configuration.

47. A device according to claim 46, wherein said housing comprises a connector for connecting said housing to a cleaning apparatus, wherein said connector of said housing resists rotation of said housing relative to the cleaning apparatus.

48. A device according to claim 47, wherein said connector defines a body having a bore at least partially therethrough for receiving a connector located on the cleaning apparatus, wherein said body of said connector defines a non-circular cross-sectional profile that mates with a corresponding profile of the connector located on the cleaning apparatus such that a resulting connection between the housing and the cleaning apparatus thereby resists rotation of said housing relative to the cleaning apparatus.

49. A card-cleaning device for a printer, comprising:

a roller mounted to a frame of the printer and adjacent to a surface of a card in the printer such that the roller collects debris from the surface of the card;

a pivot arm connected to the frame of the printer; and a spindle connected to said frame for receiving a cleaning media located on a core wherein the media includes at least one adhesive surface for contacting said roller to thereby remove debris from the roller, wherein said spindle comprises one or more splines, whereby said spline facilitates connection of said spindle to the core of the cleaning media, wherein said spine has a body extending axially between opposed ends and said spline extends axially along said body.

50. A device according to claim 49, wherein said spline comprises a body extending between opposed ends in a direction generally parallel to an axial direction of said spindle and said body of said spline is tapered in the axial direction along at least a portion of the body.

51. A device according to claim 49, wherein said spline comprises sidewalls that extend along said spindle a surface of said spindle to a top surface, wherein at least a portion of the sidewalls are angled.

52. A device according to claim 49, wherein said spindle comprises at least two splines spaced apart from each other creating a slot between said splines.

53. A device according to claim 49, further comprising a plurality of splines arranged circumferentially about said spindle, said splines extending in a generally axial direction of the spindle and defining a plurality of slots therebetween, a first end of each spline being tapered in the axial direction such that each slot defines a first portion and a second portion, the first portion of each slot being wider circumferential than the second portion and the first portion being disposed between a first end of the spindle and the second portion of the slot such tat each first portion of each slot is configured to guide a portion of the core of the media into said second portion when the core is advanced toward the spindle.

54. A device according to claim 49, wherein said media is located in a housing, wherein said device further comprises a connector for connecting to a connector of said housing, wherein said connector defines a body having a non-circular cross-sectional profile that mates with a corresponding profile of the connector of the housing of the media such that a resulting connection resists rotation of the housing relative to the device.

55. A card cleaning cartridge for use with a card printer comprising;

a housing adaptable for connection to a card cleaning assembly of the printer;

a supply tape core located at a first position in said housing, said supply tape core containing a media having at least one surface coated with an adhesive material;

a take up tape core located at a second position in said housing spaced apart from said supply tape core, said take up tape core receives the media as the media is paid out from said supply roll.

56. A cartridge according to claim 55, wherein at least one of said supply tape core and take up tape core comprises one or more splines located in an inner surface of said core, whereby said spline facilitates connection of said core to a spindle of the cleaning assembly of the printer.

57. A cartridge according to claim 55, wherein said housing comprises a connector for connecting said housing to the cleaning assembly of the printer, wherein said connector of said housing resists rotation of said housing relative to the cleaning apparatus.

58. A combination for cleaning cards in a card printer comprising:

a supply tape core adapted to hold a length of cleaning tape having an adhesive surface;

a take-up tape core adapted to receive said cleaning tape after it has been used; and a tape measuring arrangement configured to develop an electrical signal indicating travel of a predetermined length of cleaning tape.

59. The combination of claim 58 wherein said tape measuring arrangement comprises an encoder and coupled controller.

60. The combination of claim 58 wherein the predetermined length of cleaning tape comprises a length sufficient to clean an associated cleaning roller when operatively coupled thereto.

61. A combination for cleaning cards in a card printer comprising:

a replaceable cleaning cartridge, comprising:

a housing, and mounted within said housing a supply tape core adapted to hold a length of cleaning tape having an adhesive surface and a take-up tape core adapted to receive said cleaning tape after it has been used; and a tape measuring arrangement configured to develop an electrical signal indicating travel of a predetermined length of cleaning tape.

62. The combination of claim 61 wherein said tape measuring arrangement comprises an encoder and coupled controller.

63. The combination of claim 61 wherein the predetermined length of cleaning tape comprises a length sufficient to clean an associated cleaning roller when operatively coupled thereto.

* * * * *